US006095912A

United States Patent [19]

Ferronato

[11] Patent Number: 6,095,912

[45] Date of Patent: Aug. 1, 2000

[54] FLEXIBLE ABRASIVE MEMBER

[76] Inventor: Sandro Giovanni Giuseppe Ferronato, Noorderkerkstraat 19, NL-8081 ET Elburg, Netherlands

[21] Appl. No.: 08/908,928

[22] Filed: Aug. 8, 1997

[30] Foreign Application Priority Data

Aug. 8, 1996 [EP] European Pat. Off. ..... 96202237

[51] Int. Cl.[7] ..... B24D 11/00

[52] U.S. Cl. ..... 451/526; 451/527; 451/528; 451/529; 451/530; 451/534

[58] Field of Search ..... 451/527, 528, 451/529, 530, 534

[56] References Cited

U.S. PATENT DOCUMENTS 2,624,987 1/1953 Loofboro et al. ..... 451/548

FOREIGN PATENT DOCUMENTS

| | | | |
|---|---|---|---|
| 0 623 424 | 11/1994 | European Pat. Off. . | |
| 1164561 | 6/1989 | Japan | B24D 3/06 |
| 2 223 966 | 4/1990 | United Kingdom . | |
| WO 96/09139 | 3/1996 | WIPO . | |

*Primary Examiner*—David A. Scherbel
*Assistant Examiner*—Shantese McDonald
*Attorney, Agent, or Firm*—Young & Thompson

[57] ABSTRACT

A flexible abrasive member comprises a porous sheet carrying deposits which consist of a metal containing abrasive particles. The deposits have been applied to the porous sheet by electroplating and the sheet has been impregnated with a coating for stabilizing the deposits, The deposits comprise at least one hollow space through which the sheet extends, which hollow space is filled with coating material.

16 Claims, 1 Drawing Sheet

FLEXIBLE ABRASIVE MEMBER

BACKGROUND OF THE INVENTION

The invention relates to a flexible abrasive member, comprising a porous sheet carrying deposits which consist of a metal containing abrasive particles, which deposits have been applied to the porous sheet by electroplating and which sheet has been impregnated with a coating for stabilizing the deposits.

DESCRIPTION OF THE RELATED ART

Such an abrasive member is generally known. In the process of manufacturing such members, first of all metal deposits are formed by e.g. electrodeposition, currentless sedimentation or vacuum deposition. These deposits contain the abrasive particles, which provide the member with its abrasive character.

In a second step, a coating is applied onto the porous sheets and in the areas thereof between the deposits. Thereby, a stabilization of the deposits should be obtained.

In practice, the degree of stabilisation thus obtained is not fully satisfactory, because the backside of the deposits consist of metal deposits (the most used is nickel) which are flat and have a surface which appears to be "polished".

First it is extremely difficult to glue anything to a nickel surface with at the same time maintaining the flexibility. Even if the nickel surface is primed or etched, the adhesion qualities are not improved substantially.

The consequence is that all abrasives made by well known techniques have very low mechanical resistance and can therefore be easily damaged. In patent application PCT/NL 95/00265, already a considerable improvement of this problem has been achieved by creating cavities on the underside of the nickel deposit. This solution has improved the adhesion of the metal deposit to its back carrier sheet considerably. It is able to withstand high lateral forces and is therefore a very resistant product,

SUMMARY OF THE INVENTION

The problem of damages caused to leverage forces has however not been solved yet and this is the subject of the present invention.

The object of the invention is therefore to provide an abrasive member of the kind described before wherein a better stabalization of the deposits is obtained.

This object is achieved in that the deposits comprise at least one hollow space through which the sheet extends, which hollow space is filled with coating material. The hollow space(s) extend through the deposit and through the open, porous layer. Therefore on the inside of the deposit, the porous sheet is partially exposed and can be impregnated with glues such as silicon, polyester, polyurethane or epoxy glues.

The glue is thus mechanically interlinked to the deposit and the adhesion from the deposit to the carrier back sheet is substantially increased as well as the resistance to leverage forces. Thus a highly resistant and strong abrasive is created which remains highly flexible with coating material Because the coating in the member according to the invention has formed protrusions which extend into the correspondingly formed hollow spaces in the deposits, a much greater stabilisation is obtained. The protrusions form a unity with the rest of the coating, which makes them lock the deposits in their position.

The hollow spaces and protrusions can be carried out in any desired shapes and numbers. In particular, the hollow space of a deposit may be a through going hole, Thereby, the deposits may be stabilised even better, in particular in case they are sandwiched between two layers of coating, the layers being interconnected by the through going protrusions or columns.

Preferably, the hollow space is an essentially cylindrical hole. The correspondingly shaped protrusions are carried out cylindrically as well.

Of course, several hollow spaces may be applied for stabilising a deposit.

BRIEF DESCRIPTION OF THE DRAWINGS

The invention will further be described with reference to some embodiments shown in the figures.

DESCRIPTION OF THE PREFERRED EMBODIMENT

Figure 1:
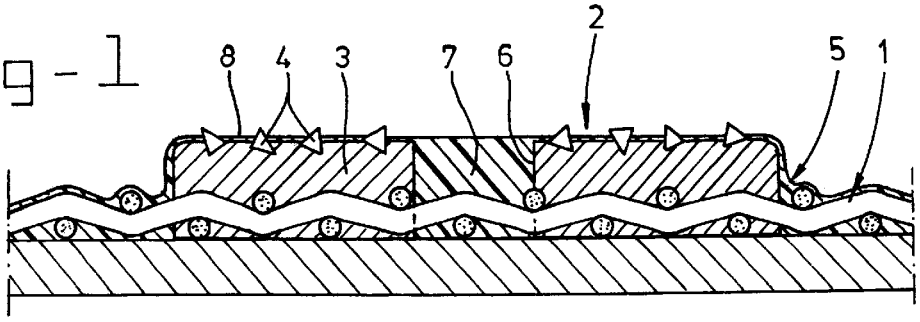
FIG. 1 shows a cross section through a flexible abrasive member according to the invention.

The flexible abrasive member according to FIG. 1 contains a porous sheet 1, carrying a deposit 2 which has been applied by electro-plating. The deposit 2 consists of a metal material 3, in which abrasive particles 4 have been imbedded. The metal material 3 has also impregnated the porous sheet 1. Furthermore, a coating material 5 has been applied which has also been impregnated in the porous sheet 1.

According to the invention, the deposit carries at least one hole or hollow space 6, which is also filled with the coating material. Moreover, a thin layer of coating material 8 may be present on the top surface of the deposit.

The coating may comprise a silicon, polyester, polyurethane or epoxy glue.

Due to the presence of a hole 6 in the deposit, filled with coating material 7 which forms a unity with the rest of the coating material 5, a very stable position of the deposit 2 with respect to shear forces is obtained. Thus hole 6 acts as a stabilizing region.

Figure 2:
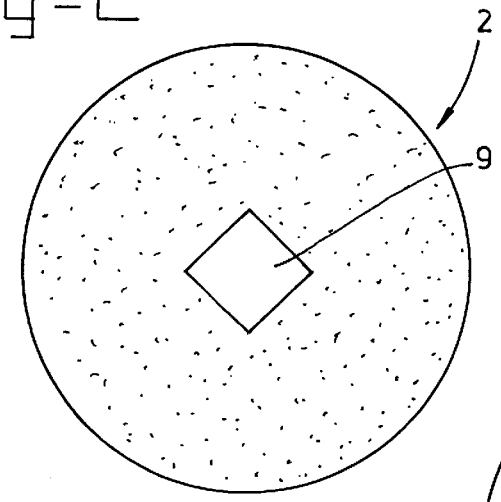
FIGS. 2 up to 4 show views on several embodiments of the invention.
Figure 3:
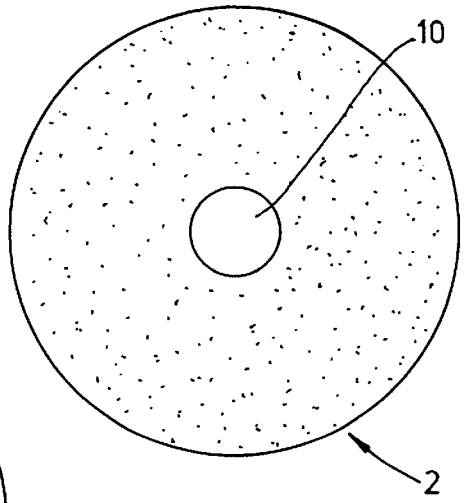
Figure 4:
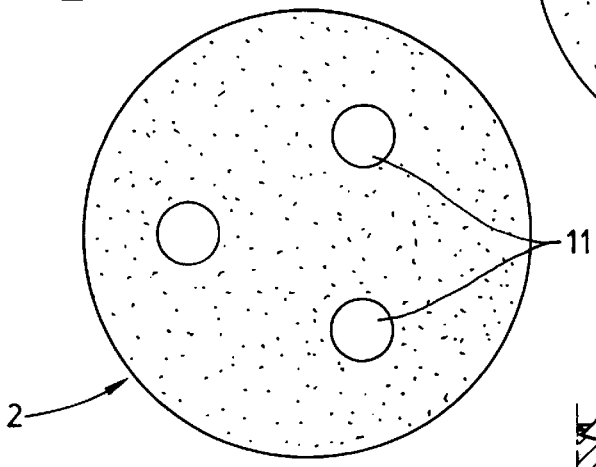

As shown in FIGS. 2 up to 4, the hole in the deposit 2 may take several forms, such as a rectangular hole 9 (FIG. 2) or a circular hole 10 (FIG. 3); also, several circular holes 11 (FIG. 4) together are possible.

Figure 5:
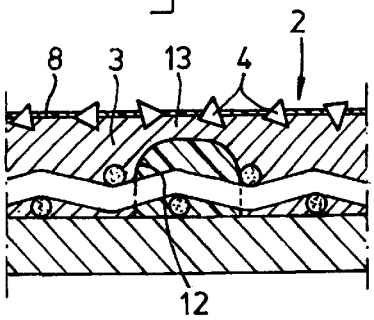
FIG. 5 shows a further embodiment.

FIG. 5 shows an embodiment wherein the metal material has a cavity 12, which at the top is closed by metal covering material 13.

What is claimed is:

1. A flexible abrasive member comprising:

a porous sheet impregnated with deposits comprising a metal with abrasive particles, said deposits being electroplated to said porous sheet, said deposits being impregnated with a stabilizing coating for stabilizing said deposits, said deposits comprising at least one hollow space with said porous sheet extending through said at least one hollow space, said at least one hollow space being filled with said stabilizing coating and filling said hollow space.

2. The member of claim 1, wherein the at least one hollow space of one of said deposits is a through going hole.

3. The member of claim 2, wherein the at least one hollow space is an essentially cylindrical hole.

4. The member of claim 3, wherein the one deposit is cylindrically shaped, and the at least one hollow space is a cylindrical hole situated essentially centrally within said deposit.

5. The member of claim 3, wherein the one deposit comprises at least two of said hollow spaces.

6. The member of claim 1, wherein the coating comprises silicon, polyester, polyurethane or epoxy glue.

7. The member of claim 1, wherein the at least one hollow space is closed at the top.

8. A flexible abrasive member comprising:

a porous sheet;

deposits comprising a metal with abrasive particles being carried on said porous sheet, said deposits being electroplated to said porous sheet, said deposits being impregnated with a stabilizing coating for stabilizing said deposits; and stabilizing hollow spaces within said deposits, said porous sheet extending through said stabilizing hollow spaces, said stabilizing hollow spaces being filled with said stabilizing coating.

9. The member of claim 8, wherein one of said stabilizing hollow spaces comprises a through-going hole extending through one of said deposits from a lower surface to an upper surface of said one deposit.

10. The member of claim 9, wherein said through-going hole is essentially cylindrical.

11. The member of claim 10, wherein said through-going hole is located essentially centrally within said deposit.

12. The member of claim 9, wherein said deposits comprise at least two of said stabilizing hollow spaces.

13. The member of claim 8, where said stabilizing coating is one of silicon, polyester, polyurethane, and epoxy glue.

14. The member of claim 8, wherein at least one of said stabilizing hollow spaces is closed at a region top and is covered by said metal.

15. The member of claim 8, wherein said stabilizing hollow spaces form a unity with said stabilizing coating.

16. The member of claim 8, wherein one of said stabilizing hollow spaces comprises a rectangular horizontal cross section.

* * * * *